United States Patent [19]

Schimko

[11] 4,240,274

[45] Dec. 23, 1980

[54] RECIPROCATING SLED DRIVE FOR A FLAT BED KNITTING MACHINE

[75] Inventor: Reinhold Schimko, Aalen-Wasseralfingen, Fed. Rep. of Germany

[73] Assignee: Universal Maschinenfabrik Dr. Rudolf Scheiber GmbH & Co. KG, Westhausen, Fed. Rep. of Germany

[21] Appl. No.: 40,821

[22] Filed: May 21, 1979

[30] Foreign Application Priority Data

May 22, 1978 [DE] Fed. Rep. of Germany ..... 2822293

[51] Int. Cl.[2] ..... D04B 7/04

[52] U.S. Cl. ..... 66/64; 66/60 R

[58] Field of Search ..... 66/60, 64

[56] References Cited

U.S. PATENT DOCUMENTS 1,902,151 3/1933 Welch et al. ..... 66/60

3,436,933 4/1969 Steiger ..... 66/64

3,550,399 12/1970 Juncu et al. ..... 66/64

*Primary Examiner*—Ronald Feldbaum

*Attorney, Agent, or Firm*—Sughrue, Rothwell, Mion, Zinn and Macpeak

[57] ABSTRACT

The end run reversals of the reciprocating sled of a flat bed knitting machine are smoothly implemented by a roller 12 mounted on a hub 5 fixed to a link 4 of a drive chain 1 at one end. The other end of the hub is fixed to a member 6 slidable in a groove 7 of a lateral rail 8 mounted to the cross slide 9 of the sled. The roller runs on a semi-circular guide surface 13 of a support segment 14 mounted to the machine frame at each end adjacent a chain sprocket wheel 2. The support segments absorb the inertial forces of the sled and cross slide to thereby prevent the tilting of the chain links at the sprocket wheels and the attendant varying of the sled stroke.

5 Claims, 2 Drawing Figures

RECIPROCATING SLED DRIVE FOR A FLAT BED KNITTING MACHINE

Figure 1:
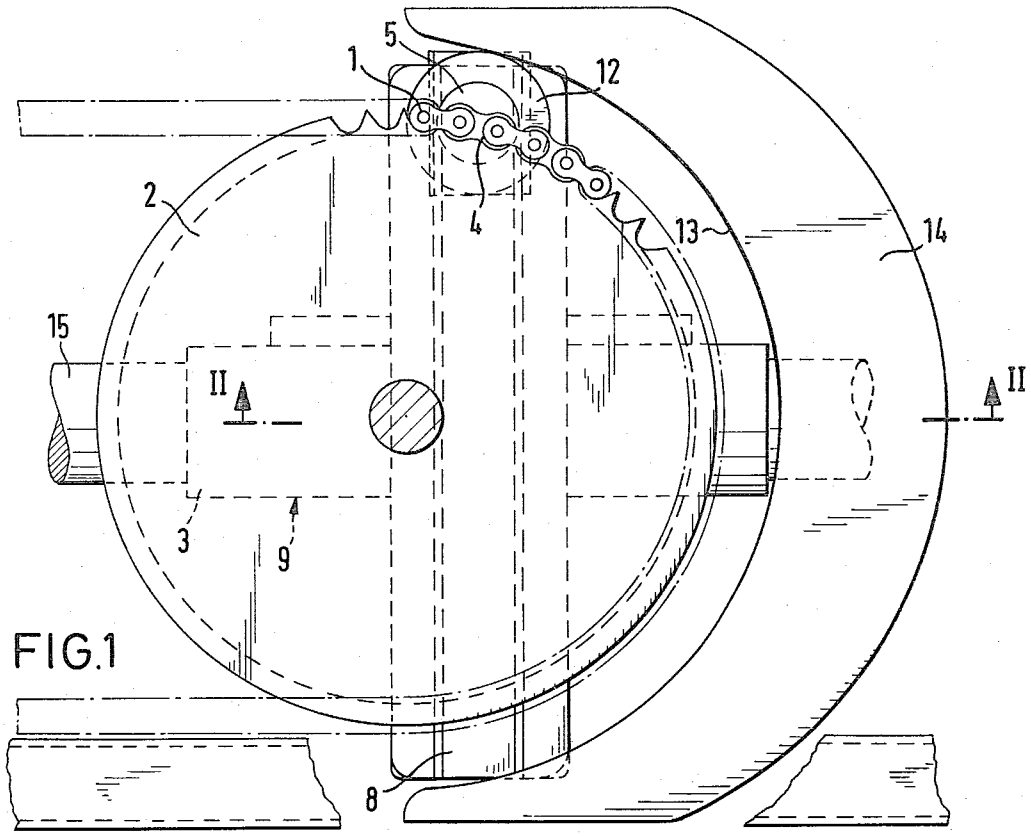

This invention relates to a drive arrangement for a flat bed knitting machine having a reciprocating sled, an endless chain guided over two sprocket wheels at the opposite ends of the needle beds, and a cross slide arranged between the sled and the endless chain.

Flat bed knitting machines having reciprocating sleds are generally driven by means of an endless roller chain guided over two chain sprocket wheels. A separately guided cross slide is located on the sled, which enables the sled to be engaged at its center of gravity so that no distorting forces are transferred to it. The cross slide is connected with the roller chain by a carrier bolt or the like.

At the sled return or reversing locations the moving mass of the sled and the cross slide must be braked by the chain links and carrier bolts running over the sprocket wheel. In so doing the chain elements on the sprocket wheel are prone to tipping or canting; a supporting segment or guide element bearing against the chain rollers keeps the chain from lifting away from the sprocket wheel, but cannot prevent it from tipping. This leads to different centrifugal forces being developed at various speeds of the drive, as a result of which the entire stroke path of the sled varies.

A flat bed knitting machine is disclosed in the magazine "Wirkereiund Strickerei-Technik", Coburg, January 1954, No. 1, page 25, in which guide elements are provided in the reversing area of the sled for holding the chain rollers in the base of the sprocket teeth during their turnaround or direction reversal, but this arrangement is still ineffective to prevent the chain from tilting.

A further flat bed knitting machine disclosed in the magazine "Textilbetrieb", May 1977, pages 44 through 46, includes roller chain and cross head guides for the sled drive, and a chain link coupling pin is pivotably mounted in a sliding member of the cross head guide. Half-moon shaped chain supports prevent the lifting of the roller chain from the sprocket wheel during the turning of the sled, but again do not prevent the tilting of the chain members.

Link controls on the sled and the adjustment of its rigidity are typically effected by means of latches; different stroke lengths of the sled therefore have an unfavorable effect on the control precision. The switching paths from one position to another must be very large for safety reasons, and the entire travel path thereby increases, which unfavorably influences the productivity of the machine because all switches can only be undertaken when the sled has left the needle area. In addition, latches are activated by the counter motion of the sprocket wheels when run against a stop in order to arrive at any given position from any other position. As a result of the different sled strokes, a large safety space must thus be included between the stop and latch. If the switching path is too long, however, the other side of the sled forms a very hard and solid stop which causes the entire machine to shudder.

The basic purpose of this invention is thus to provide a drive arrangement in which the sled stroke can be reliably and accurately predetermined independent of the drive speed.

This object is achieved according to the invention in that for each chain sprocket wheel there is provided a guide surface which limits the outward movement of the cross slide in the reversing area of the sled. A force transmitting connecting element which is slidably connected to the cross slide in the reversing area of the sled bears against and is limited by the guide surface. The cross slide and sled are thus accurately guided along a predetermined path by the chain on the inside and by the guide surface on the outside.

The guide surface is preferably formed as a semi-circle on the inside of a support element rigidly attached to the machine support frame. The connecting element is mounted between the chain and the cross slide, and includes a roller which runs on the guide surface to assure the calm and smooth movement of the connecting element.

Figure 2:
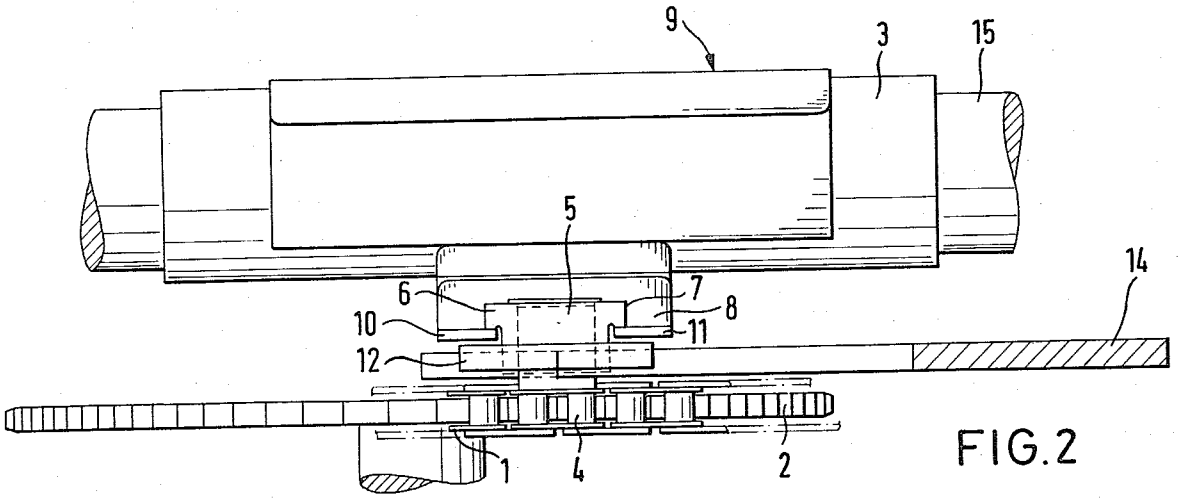

In the drawings:

FIG. 1 shows a front view of a drive arrangement according to the invention in the reversing area of the sled on the right side of the machine, and FIG. 2 shows a top view of the drive taken along line II—II in FIG. 1, with the support element being sectioned.

In the drawing only the right side of the drive of a flat bed knitting machine is shown. The left side of the drive is formed as a mirror image in the opposite reversing area of the sled. A roller chain 1 is mounted on two chain sprocket wheels, of which only the sprocket wheel 2 on the right side of the machine is shown. One of the sprocket wheels is driven.

A cross slide 9 has a sleeve-like horizontal guide element 3 which slides on a guide rod 15 parallel to the sled guide. A lateral or transverse rail 8 is mounted on the cross slide and has a longitudinal groove 7 facing the chain side. A slide member 6 is fitted in the groove 7, and is connected with the chain 1 by a connecting element in the form of a hub or bolt member 5 mounted on a link 4 of the chain. Cover plates 10 and 11 retain the slide member 6 in the groove 7. The cross slide 9 is coupled to the sled of the flat bed knitting machine (not shown).

A roller 12 is mounted on the bolt member 5 between the sprocket wheel 2 and the cross slide 9 by ball or roller bearings. In the reversing area of the sled the roller 12 runs around a guide surface 13 of a support segment 14, whereby the movement of the cross slide 9 and its associated sled is outwardly limited and precisely determined. The support segment 14 is rigidly mounted on the machine support frame, and prevents the cross slide 9 and associated sled from tilting the chain link 4 and bolt member 5 by the force inherent in their moving mass.

By having the roller 12 run on the curved guide surface 13 of the support segment 14, the sled stroke is always the same length regardless of speed. Thus, neither missed switches by latches to be switched in the reversing area of the sled nor overly hard impacts in the sled reversal occur, and shudderings of the knitting machine and hard impact noises are avoided.

What is claimed is:

1. A drive arrangement for a flat bed knitting machine having a reciprocating sled, an endless chain guided and driven by two sprocket wheels arranged at the opposite ends of the needle beds, and a cross slide arranged between the sled and the endless chain, characterized by: a guide surface (13) for each sprocket wheel to limit the outward movement of the cross slide (9) in the reversing area of the sled, and a force transmitting connecting element (5) slidably coupled to the cross slide (9) and engagable with the guide surface in the reversing area of the sled.

2. A drive arrangement according to claim 1, wherein the guide surface is a semi-circle on the inside of a support element (14) rigidly mounted to the machine support stand.

3. A drive engagement according to claims 1 or 2, wherein the connecting element is disposed between the chain (1) and the cross slide.

4. A drive arrangement according to claim 3, wherein a roller (12) is mounted on the connecting element and runs on the guide surface.

5. A drive arrangement according to claim 4, wherein the cross slide is slidably mounted on a guide rod (15) parallel to the sled guide.

* * * * *